US010011463B2

(12) United States Patent
Kwon et al.

(10) Patent No.: US 10,011,463 B2
(45) Date of Patent: Jul. 3, 2018

(54) ELEVATOR DOOR FRICTION BELT DRIVE INCLUDING ONE OR MORE MARKERS

(71) Applicant: Otis Elevator Company, Farmington, CT (US)

(72) Inventors: YiSug Kwon, Farmington, CT (US); John Ferrisi, Avon, CT (US)

(73) Assignee: Otis Elevator Company, Farmington, CT (US)

( * ) Notice: Subject to any disclaimer, the term of this patent is extended or adjusted under 35 U.S.C. 154(b) by 358 days.

(21) Appl. No.: 14/759,588

(22) PCT Filed: Jan. 8, 2013

(86) PCT No.: PCT/US2013/020664
§ 371 (c)(1),
(2) Date: Jul. 7, 2015

(87) PCT Pub. No.: WO2014/109731
PCT Pub. Date: Jul. 17, 2014

(65) Prior Publication Data

US 2015/0344268 A1 Dec. 3, 2015

(51) Int. Cl.
*B66B 1/34* (2006.01)
*B66B 13/08* (2006.01)
*B66B 13/14* (2006.01)

(52) U.S. Cl.
CPC ..... *B66B 13/08* (2013.01); *B66B 13/143* (2013.01); *B66B 13/146* (2013.01)

(58) Field of Classification Search
CPC ..... B66B 13/08; B66B 13/143; B66B 13/146
USPC ..... 187/247, 315, 316, 317, 327, 391, 393; 318/280–286; 49/334, 349, 352, 26, 28, 49/31; 340/545.1, 545.2, 545.3, 547; 160/133, 197, 171, 176.1 P; 198/833
See application file for complete search history.

(56) References Cited

U.S. PATENT DOCUMENTS 2,363,336 A * 11/1944 Keeler ..... G05D 23/22 236/69
3,696,946 A 10/1972 Hunter et al.
4,264,905 A * 4/1981 Shapiro ..... G01P 13/00 198/502.4
4,711,323 A * 12/1987 Haas ..... B66B 13/08 187/324
4,832,158 A 5/1989 Farrar et al.
(Continued)

FOREIGN PATENT DOCUMENTS

DE 102006002118 5/2007
EP 0701961 3/1996
(Continued)

OTHER PUBLICATIONS

Extended EP Search Report dated Aug. 18, 2016.

*Primary Examiner* — Anthony Salata
(74) *Attorney, Agent, or Firm* — O'Shea Getz P.C.

(57) ABSTRACT

An elevator system includes a linkage, a control system and a friction belt drive. The linkage is adapted to attach to an elevator door. The friction belt drive is adapted to move the elevator door with the linkage between an open position and a closed position. The friction belt drive includes a v-belt with one or more markers arranged along a length of the v-belt. The control system is adapted to control the friction belt drive, and includes a sensor adapted to detect at least one of the markers.

19 Claims, 6 Drawing Sheets

(56) References Cited

U.S. PATENT DOCUMENTS

| | | | | |
|---|---|---|---|---|
| 4,926,974 | A | 5/1990 | Morris et al. | |
| 5,060,763 | A | 10/1991 | Garrido et al. | |
| 5,096,044 | A | 3/1992 | Biebel | |
| 5,383,014 | A | 1/1995 | Nowak et al. | |
| 5,587,565 | A * | 12/1996 | Schroder-Brumloop | G05B 19/416 187/316 |
| 5,594,219 | A | 1/1997 | Kamani et al. | |
| 5,625,175 | A | 4/1997 | Gutknecht et al. | |
| 5,651,428 | A | 7/1997 | Ahigian et al. | |
| 5,659,160 | A | 8/1997 | Tracey | |
| 5,701,973 | A | 12/1997 | Tracey | |
| 5,878,846 | A | 3/1999 | O'Donnell | |
| 5,881,844 | A | 3/1999 | Thompson et al. | |
| 5,949,036 | A | 9/1999 | Kowalczyk et al. | |
| 6,000,503 | A | 12/1999 | Draper et al. | |
| 6,179,419 | B1 | 1/2001 | Rasmussen et al. | |
| 6,513,628 | B2 * | 2/2003 | Mollenauer | B66B 13/08 187/315 |
| 7,202,615 | B2 | 4/2007 | Morris et al. | |
| 7,428,950 | B2 | 9/2008 | del Rio et al. | |
| 7,540,357 | B2 * | 6/2009 | Finn | B66B 1/3492 187/394 |
| 7,578,373 | B2 * | 8/2009 | Shiratsuki | B66B 5/0037 187/391 |
| 7,617,860 | B2 * | 11/2009 | Spiess | B66B 13/08 160/133 |
| 7,681,695 | B2 | 3/2010 | Christen | |
| 7,905,332 | B2 | 3/2011 | Jayachandran | |
| 7,938,233 | B2 * | 5/2011 | Kunz | B66B 1/3492 187/394 |
| 8,074,789 | B2 | 12/2011 | May | |
| 9,399,562 | B2 * | 7/2016 | Terry | B66B 1/3492 |
| 9,511,976 | B2 * | 12/2016 | Kang | B66B 1/3492 |
| 2008/0047784 | A1 | 2/2008 | Krause et al. | |
| 2011/0138691 | A1 | 6/2011 | Lemstra | |
| 2011/0138692 | A1 | 6/2011 | Lemstra | |

FOREIGN PATENT DOCUMENTS

| | | |
|---|---|---|
| EP | 1095895 | 9/2000 |
| EP | 1820767 | 2/2007 |
| JP | H0485277 | 3/1992 |
| JP | 2002-348075 | 12/2002 |
| JP | 2008168957 | 7/2008 |
| JP | 2010137956 | 6/2010 |
| KR | 101111163 | 2/2012 |
| WO | 2011000064 | 6/2009 |
| WO | 2011027450 | 3/2011 |
| WO | 2011111096 | 9/2011 |

* cited by examiner

ELEVATOR DOOR FRICTION BELT DRIVE INCLUDING ONE OR MORE MARKERS

This application is entitled to the benefit of, and incorporates by reference essential subject matter disclosed in PCT Application No. PCT/US2013/020664 filed on Jan. 8, 2013.

BACKGROUND OF THE INVENTION

1. Technical Field

This disclosure relates generally to an elevator and, more particularly, to a belt drive for opening and closing an elevator door.

2. Background Information

An elevator car typically includes a drive for opening and closing an elevator door. In some cases, the drive may be a belt drive, wherein a belt having a plurality of protrusions (e.g., cogs or teeth) arranged along its length is wrapped around a plurality of sheaves. The belt protrusions mesh with corresponding protrusions on the sheaves, preventing the belt from slipping relative to the sheaves. The meshing between the protrusions, however, may generate undesirable noise.

Alternatively, friction belt drives may be used to drive elevator doors. Such friction belt drives use belts, for example v-belts, that are wrapped around a plurality of sheaves. Neither the belt nor the sheaves of such drives include protrusions, but instead rely on the friction between the belt and the sheaves to provide a motive force. Friction belt drives may therefore generate less noise than cogged belt drives. However, it is often difficult to precisely control friction belt drives because the belts may slip relative to one or more of the sheaves during operation. Such slippage may be at least partially accounted for by monitoring the position of the elevator door, or the angular position of one of the sheaves. However, systems for monitoring the position of the elevator door and/or the angular position of one of the sheaves may be complicated, expensive, and/or inaccurate.

There is a need in the art for an improved belt drive for opening and closing an elevator door.

SUMMARY OF THE DISCLOSURE

According to an aspect of the invention, an elevator is provided that includes a linkage, a friction belt drive and a control system. The linkage is adapted to attach to an elevator door. The friction belt drive is adapted to move the elevator door with the linkage between an open position and a closed position. The friction belt drive includes a v-belt with one or more markers arranged along a length of the v-belt. The control system is adapted to control the friction belt drive, and includes a sensor adapted to detect at least one of the markers.

According to another aspect of the invention, an elevator system is provided that includes a linkage and a friction belt drive, which is adapted to move an elevator door with the linkage between an open position and a closed position. The friction belt drive includes a motor, a plurality of sheaves, a cogged belt and a sensor. The sheaves include a first sheave that is connected to the motor. The cogged belt is wrapped around the sheaves. The sensor is adapted to detect at least one of the protrusions. The linkage is adapted to attach to at least one panel of the elevator door.

According to still another aspect of the invention, a system is provided for moving a door between an open position and a closed position. The system includes a motor, a plurality of sheaves, a v-belt, a linkage and a control system. The sheaves include a plain sheave that is connected to the motor. The v-belt is wrapped around the sheaves. The v-belt includes one or more markers arranged along a length of the v-belt, where a first of the markers is configured as a protrusion or an aperture. The linkage is adapted to connect the v-belt to the elevator door. The control system is adapted to control the motor, and includes a sensor that is adapted to detect at least one of the markers.

Alternatively or in addition to this or other aspects of the invention, the first of the markers may be configured as a protrusion.

Alternatively or in addition to this or other aspects of the invention, the first of the markers may be configured as an aperture. The aperture may be configured as a through-hole, a dimple (e.g., a non-through hole), a groove or a slot.

Alternatively or in addition to this or other aspects of the invention, a first of the markers may be configured as a device that is adapted to disturb a magnetic, electric, radio and/or optical field.

Alternatively or in addition to this or other aspects of the invention, the v-belt may have a trapezoidal cross-sectional geometry.

Alternatively or in addition to this or other aspects of the invention, the v-belt may form a loop and extend between an inner belt side and an outer belt side. Some or all of the markers may be arranged at the inner belt side. Some or all of the markers may also or alternatively be arranged at the outer belt side.

Alternatively or in addition to this or other aspects of the invention, the sensor may be configured as a proximity sensor, an optical sensor, a touch sensor, a magnetic sensor, or a near field sensor.

Alternatively or in addition to this or other aspects of the invention, the friction belt drive may include a motor, a first sheave that is connected to the motor, and a second sheave. The v-belt may wrap around the first and the second sheaves.

Alternatively or in addition to this or other aspects of the invention, the first sheave may be configured as a plain sheave.

Alternatively or in addition to this or other aspects of the invention, the motor may be adapted to rotate the first sheave in response to receiving a control signal. The sensor may be adapted to provide a sensor signal indicative of a position of at least one of the markers. The control system may include a controller that is adapted to receive the sensor signal, and provide the control signal as a function of the sensor signal to at least partially compensate for slippage between the v-belt and the first sheave.

Alternatively or in addition to this or other aspects of the invention, the sensor may be adapted to provide a sensor signal indicative of a position of at least one of the markers. The control system may be adapted to determine a position of the elevator door as a function of the sensor signal.

Alternatively or in addition to this or other aspects of the invention, the friction belt drive may include a second motor that is connected to the second sheave.

Alternatively or in addition to this or other aspects of the invention, the system may include the elevator door, which may include one or more door panels. The linkage may be attached to at least one of the one or more door panels.

Alternatively or in addition to this or other aspects of the invention, the cogged belt may be configured as a v-belt with a plurality of protrusions arranged along a length of the v-belt.

Alternatively or in addition to this or other aspects of the invention, the control system may include a controller that is adapted to receive the sensor signal from the sensor. The controller may also be adapted to provide a control signal to the motor as a function of the sensor signal to at least partially compensate for slippage between the v-belt and the plain sheave.

The foregoing features and the operation of the invention will become more apparent in light of the following description and the accompanying drawings.

DETAILED DESCRIPTION OF THE INVENTION

Figure 1:
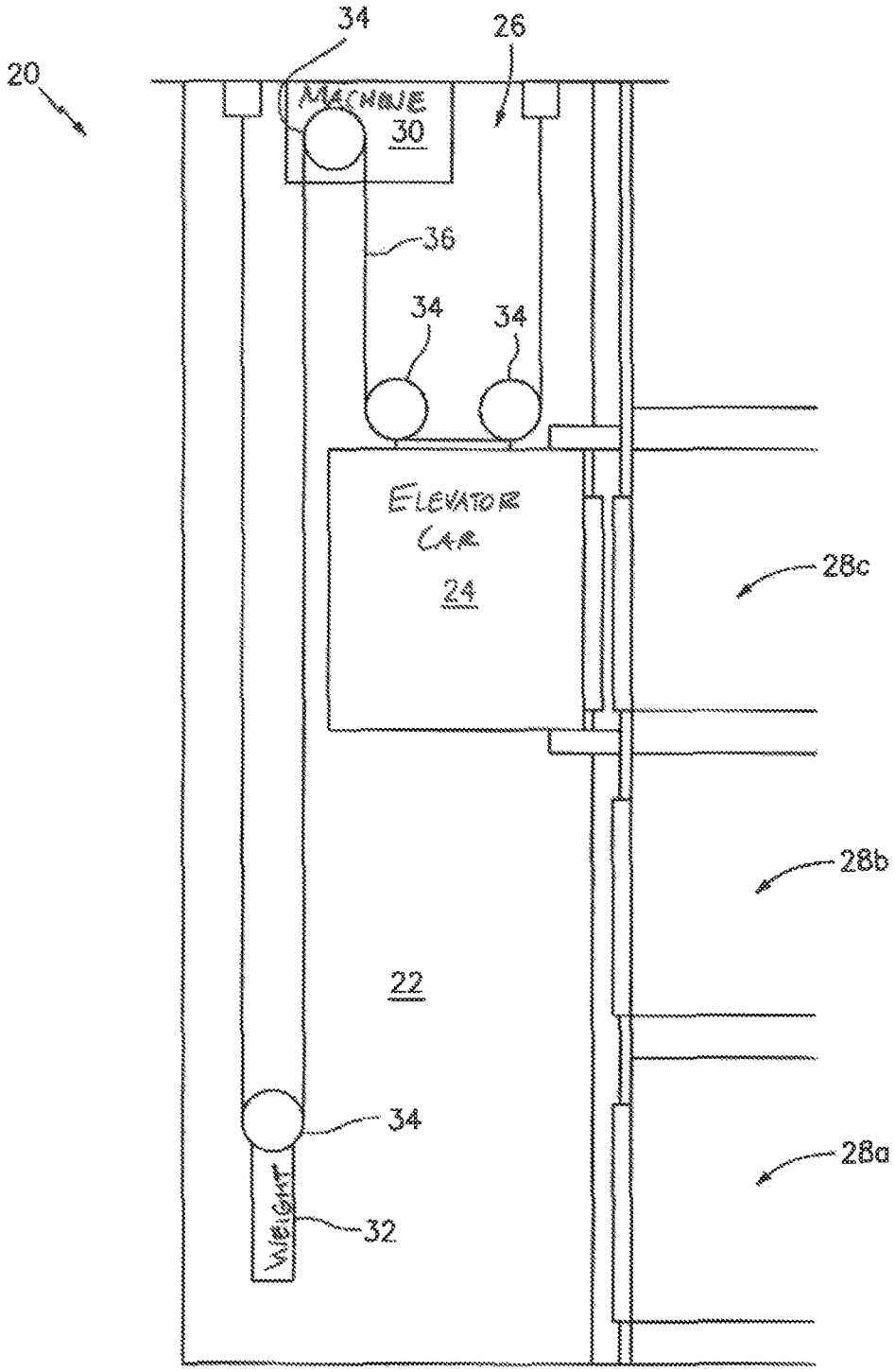
FIG. 1 is a schematic illustration of a traction elevator arranged within a building hoistway.

FIG. 1 is a schematic illustration of a traction elevator 20 arranged within a building hoistway 22. The elevator 20 includes an elevator car 24 and an elevator drive system 26, which moves the elevator car 24 vertically within the hoistway 22 between a plurality of landings 28*a*, 28*b*, 28*c*, etc. The elevator drive system 26 includes an elevator machine 30, a counterweight 32, a plurality of sheaves 34, and one or more load bearing members 36; e.g., ropes, belts, cables, etc. These load bearing members 36 are wrapped (e.g., serpentined) around the sheaves 34. The load bearing members 36 connect the elevator car 24 to the machine 30 and the counterweight 32.

Figure 2:
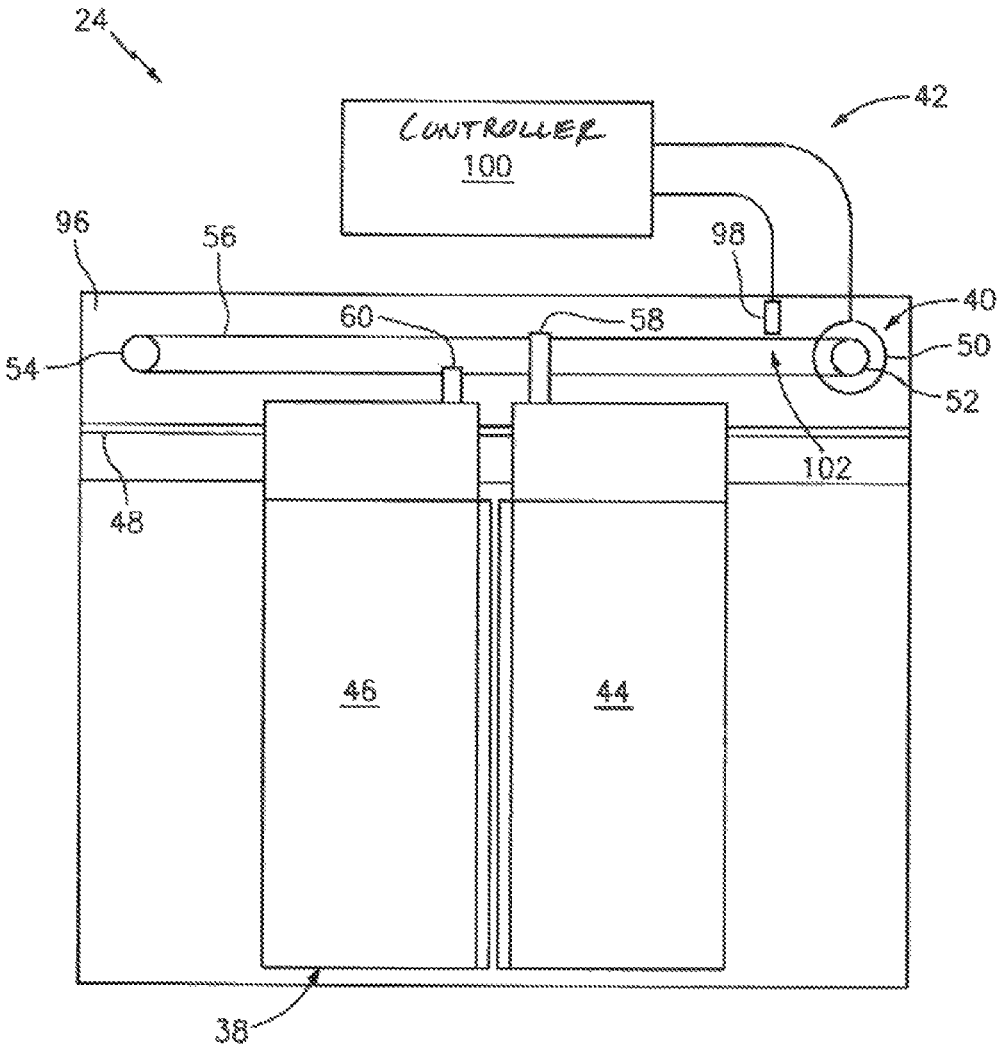
FIG. 2 is a schematic illustration of an elevator car with an elevator door in a closed position.
Figure 3:
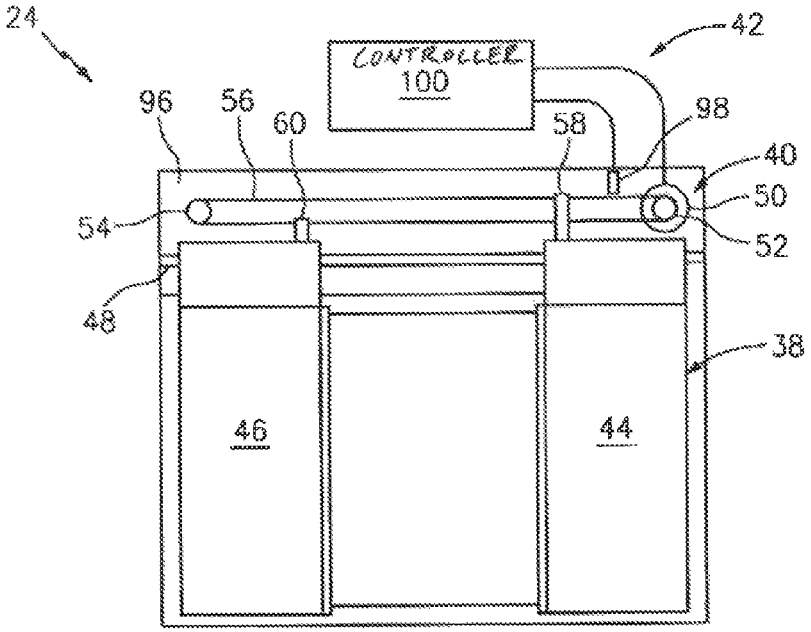
FIG. 3 is a schematic illustration of an elevator car with an elevator door in an open position.

FIGS. 2 and 3 are schematic illustrations of the elevator car 24. The elevator car 24 includes an elevator door 38, a friction belt drive 40, and a control system 42. The elevator door 38 includes one or more elevator door panels 44 and 46, which may move along a track 48 between a closed position (see FIG. 2) and an open position (see FIG. 3).

The friction belt drive 40 may be configured as a linear drive. The friction belt drive 40 is adapted to move the elevator door panels 44 and 46 between the closed position and the open position. The friction belt drive 40 includes a motor 50 (e.g., an electric step motor), a plurality of sheaves 52 and 54, at least one belt 56, for example a v-belt, and one or more door linkages 58 and 60 (e.g., elevator door couplers such as brackets).

Figure 4:
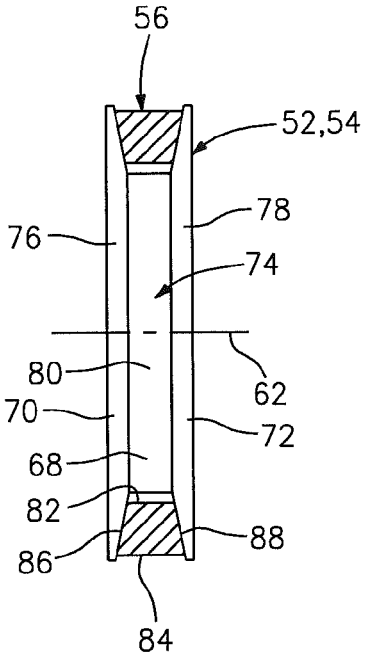
FIG. 4 is an illustration of a portion of a v-belt wrapped around a sheave.
Figure 5:
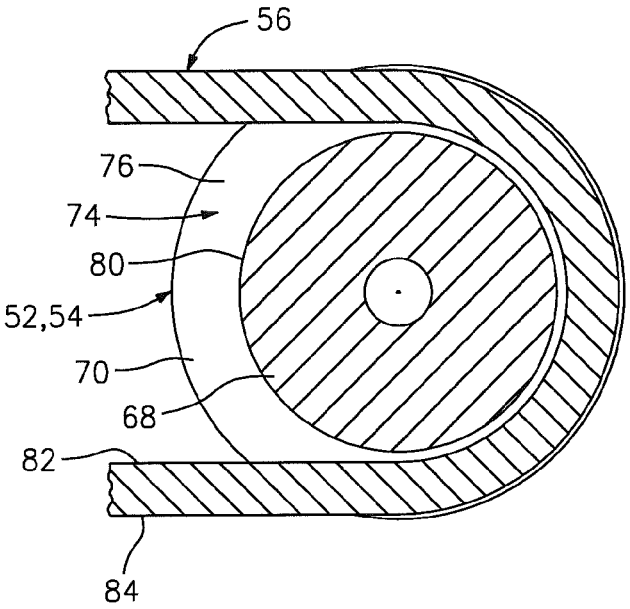
FIG. 5 is a sectional illustration of the v-belt and sheave of FIG. 4.
Figure 6:
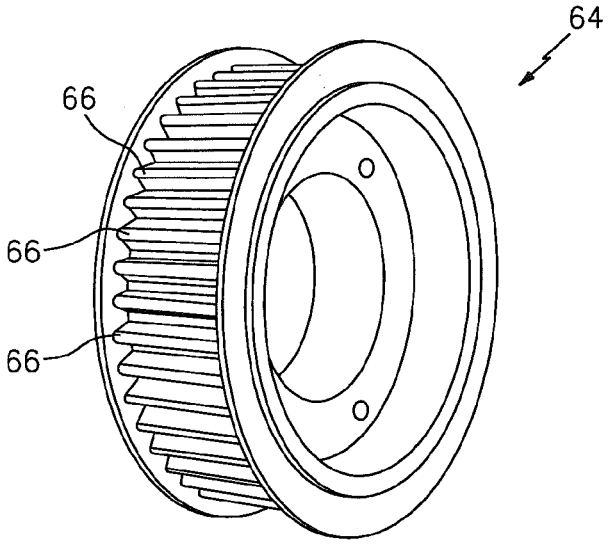
FIG. 6 is a perspective illustration of a cogged sheave.

Referring to FIGS. 4 and 5, one or more of the sheaves 52 and 54 may each be configured as a plain sheave that is rotatable about an axis 62. The term "plain sheave" refers to a cogless or toothless sheave. By contrast, a non-plain sheave such as a cogged or toothed sheave 64 includes a plurality of circumferentially arranged cogs or teeth 66 as illustrated in FIG. 6.

Referring again to FIGS. 4 and 5, one or more of the sheaves 52 and 54 each includes a sheave base 68, a plurality of annular sheave flanges 70 and 72, and an annular sheave groove 74. Each of the flanges 70 and 72 extends radially out from the base 68, and includes a canted sheave side surface 76 and 78. The side surface 76, 78 is angled relative to a radial plane (e.g., a plane perpendicular to the axis 62) of the respective sheave 52, 54 by between about thirty and about forty degrees. A groove bottom surface 80 of the base 68 extends circumferentially around the axis 62, and axially between inner ends of the side surfaces 76 and 78. This bottom surface 80 may have a substantially smooth circular cross-sectional geometry; e.g., substantially uninterrupted by protrusions or apertures. Alternatively, the bottom surface 80 may be wrinkled or include one or more dimples and/or protrusions other than cogs or teeth; e.g., manufacturing imperfections, etc. The groove 74 extends radially into the respective sheave 52, 54 to the bottom surface 80. The groove 74 extends axially between the side surfaces 76 and 78. The groove 74 may have a trapezoidal (e.g., an isosceles trapezoidal) cross-sectional geometry as illustrated in FIG. 4. Alternatively, the groove may have a triangular (e.g., equilateral triangular) cross-sectional geometry, or any other type of substantially wedge-shaped cross sectional geometry.

The belt 56 may form a continuous loop as illustrated in FIGS. 2 and 3. Referring to FIGS. 4 and 5, the belt 56, shown as a v-belt in this embodiment but not limited to such in alternate embodiments, extends radially, relative to the axis 62, between an inner belt side 82 and an outer belt side 84. The belt 56 extends axially, relative to the axis 62, between opposing canted belt side surfaces 86 and 88. Each of the side surfaces 86, 88 is angled relative to the radial plane of the respective sheave 52, 54 by between about thirty and about forty degrees. These side surfaces 86 and 88 provide the belt 56 with a trapezoidal (e.g., an isosceles trapezoidal) cross-sectional geometry that tapers towards the inner belt side 82. Alternatively, the belt 56 may have a triangular (e.g., equilateral triangular) cross-sectional geometry, or any other type of substantially wedge-shaped cross sectional geometry.

Figure 7:
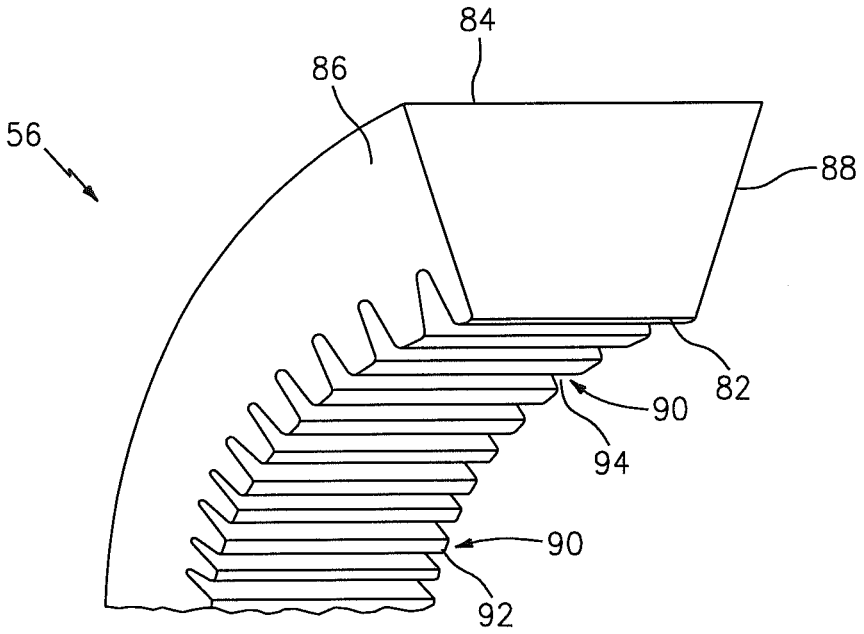
FIG. 7 is a perspective illustration of a portion of a cogged timing belt.
Figure 8:
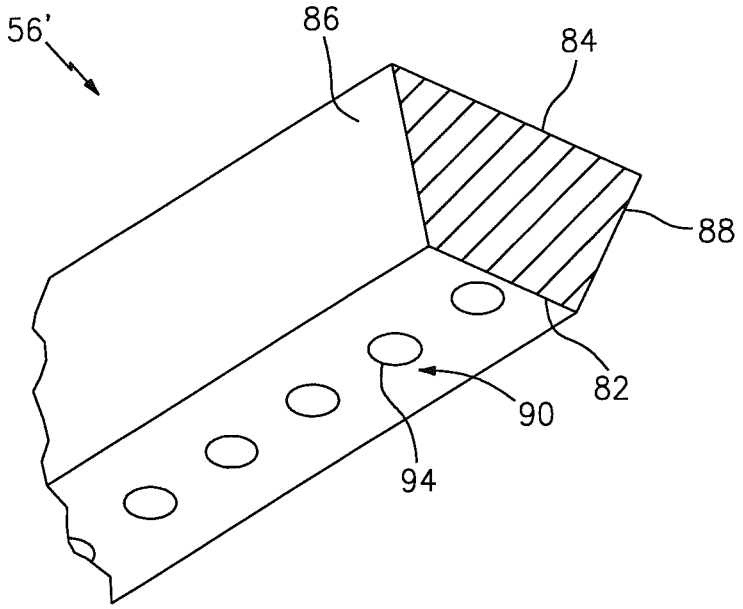
FIG. 8 is a perspective illustration of a portion of an apertured v-belt.

Referring to FIGS. 7 and 8, the belt 56 includes one or more markers 90 arranged along a length of the belt 56. Each of these markers 90 is arranged at a respective, discrete angular location along the length of the belt 56. Referring to FIG. 7, one or more of the markers 90 may be configured as protrusions 92; e.g., cogs, teeth, pedestals, etc. Referring to FIGS. 7 and 8, one or more of the markers 90 may be configured as apertures 94; e.g., grooves, slots, dimples (e.g., non-through holes), through holes, etc. Alternatively, one or more of the markers 90 may be graphic elements that are printed on, applied to or otherwise incorporated into the material of the belt 56. Alternatively, one or more of the markers 90 may comprise a different material than the belt 56, for example, the marker 90 may be a magnetic element embedded into, or attached to, the belt 56, or any other device that may disturb a magnetic, electric, radio, or optical field. One or more of the markers 90 may be located at (e.g., on, adjacent or proximate) the inner belt side 82 as illustrated in FIGS. 7 and 8. The belt 56 of FIG. 7, for example, is configured with a plurality of cogs 92 located at the inner belt side 82. Alternatively, one or more of the markers 90 may be located at the outer belt side 84.

Referring to FIGS. 2 and 3, the motor 50 is connected to a header 96 of the elevator car 24. The first sheave 52 (e.g., a drive sheave) is connected to an output shaft of the motor 50. The second sheave 54 (e.g., an idler sheave) is rotatably connected to the header 96. The belt 56 is wrapped around and engaged with the sheaves 52 and 54. In particular, referring to FIGS. 4 and 5, a portion of the length of the belt 56 is positioned within the sheave groove 74. This portion of the belt 56 is wedged between the sheave flanges 70 and 72, which axially compresses the material of the belt 56 between the flange side surfaces 76 and 78. The belt side surfaces 86 and 88 therefore respectively frictionally contact the sheave side surfaces 76 and 78. A gap may extend radially between the inner belt side 82 and the bottom surface 80 as illustrated in FIGS. 4 and 5. Alternatively, the inner belt side 82 may engage the bottom surface 80, for example, to limit the compression of the belt 56. Referring to FIGS. 2 and 3, the first linkage 58 connects the first elevator door panel 44 to a first run of the belt 56 extending between the sheaves 52 and 54. The second linkage 60 connects the second elevator door panel 46 to a second run of the belt 56 extending between the sheaves 52 and 54.

Referring still to FIGS. 2 and 3, the control system 42 includes at least one belt position sensor 98 and a controller 100 (e.g., a feedback encoder). The sensor 98 is adapted to detect one or more of the markers 90 (see FIGS. 7 and 8) as each of those markers 90 passes a detection location 102 (see FIG. 2). The sensor 98 may be configured as a proximity sensor, an optical sensor, a touch sensor, a magnetic sensor, a near field sensor, or any other type of known sensor. The present invention is not limited to any particular sensor configurations. The sensor 98 may be connected to the header 96 adjacent the first run of the belt 56.

The controller 100 may be implemented using hardware, software, or a combination thereof. The controller 100 may be a stand-alone unit, or it may be a component or part of another unit. The hardware may include one or more processors, memory, analog and/or digital circuitry, etc. The controller 100 is configured in signal communication (directly or indirectly) with (e.g., hardwired or wirelessly connected to) the sensor 98 and the motor 50.

Figure 9:
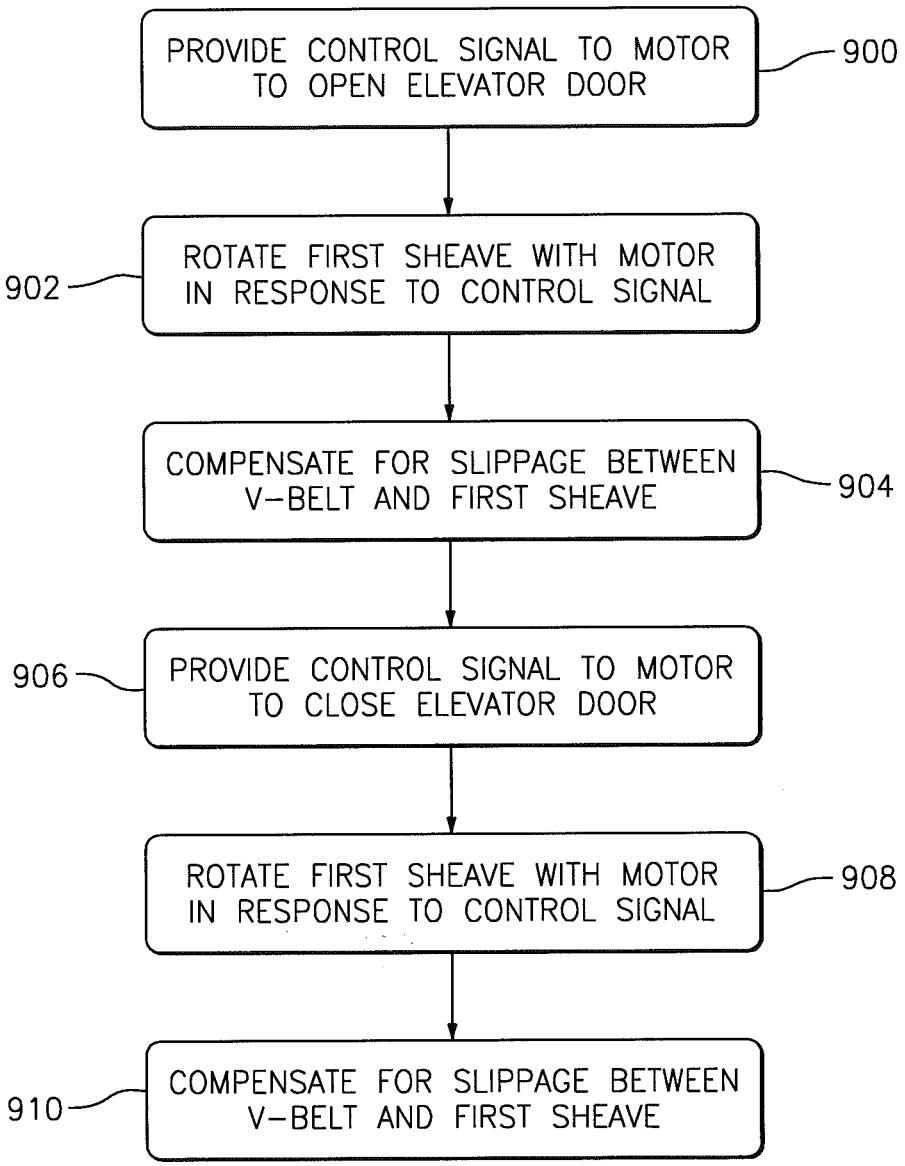
FIG. 9 is a flow diagram of a method for operating a friction belt drive.

FIG. 9 is a flow diagram of a method for operating the friction belt drive 40 of FIGS. 2 and 3. In step 900, the controller 100 provides a control signal to the motor 50 to open the elevator door 38.

In step 902, the motor 50 rotates the first sheave 52 in a first rotational (e.g., clockwise) direction in response to receiving the control signal. This rotation of the first sheave 52, through frictional contact, may cause the belt 56 to move the first linkage 58 towards the first sheave 52 and the second linkage 60 towards the second sheave 54. The linkages 58 and 60, in turn, respectively move the elevator door panels 44 and 46 from the closed position of FIG. 2 towards the open position of FIG. 3.

During the opening of the elevator door 38, the belt 56 may slip relative to the first sheave 52. In step 904, the control system 42 at least partially compensates for such belt 56 slippage. The sensor 98, for example, tracks a plurality of the markers 90 (see FIGS. 7 and 8) as the belt 56 moves around the sheaves 52 and 54. As each of these markers 90 passes the detection location 102, the sensor 98 detects the respective marker 90 and provides a sensor signal to the controller 100. The sensor signal is indicative of the position of the respective marker 90; e.g., the signal indicates a respective marker 90 is at the detection location 102 at a particular point in time. The controller 100 may compare the sensor signal to a threshold (or another signal) to determine whether the respective marker 90 passed the detection location 102 after or at an expected time of arrival. Where the respective marker 90 passed the detection location 102 after the expected time of arrival, the controller 100 may determine there is slippage between the belt 56 and the first sheave 52. The controller 100 may compensate for such slippage by providing the control signal to the motor 50 for an addition quantity of time. In this manner, the controller 100 may ensure the elevator door 38 fully opens. The controller 100 may also make a similar determination without respect to timing. For example, the controller 100 may determine whether the elevator door 38 is in position based on a number of rotations or partial rotations of the rotor of the motor 50.

In step 906, the controller 100 provides another control signal to the motor 50 to close the elevator door 38.

In step 908, the motor 50 rotates the first sheave 52 in a second rotational (e.g., counter clockwise) direction in response to receiving the control signal. This rotation of the first sheave 52 may cause the belt 56 to move the first linkage 58 towards the second sheave 54 and the second linkage 60 towards the first sheave 52. The linkages 58 and 60, in turn, respectively move the elevator door panels 44 and 46 from the open position of FIG. 3 towards the closed position of FIG. 2.

During the closing of the elevator door 38, the belt 56 may momentarily slip relative to the first sheave 52. In step 910, the control system 42 at least partially compensates for such belt 56 slippage in a similar manner as described above with respect to the step 904. In this manner, the controller 100 may ensure the elevator door 38 fully closes.

The controller 100 may also utilize the sensor signal to time the opening and closing of the elevator door 38. The controller 100, for example, may signal the motor 50 to change (e.g., increase or decrease) speed or stop when a certain marker 90 is detected by the sensor 98. The controller 100 may also or alternatively utilize the sensor signal to remotely track the position of the elevator door 38. The controller 100 may subsequently communicate to other elevator systems that the elevator door 38 is open or closed.

Figure 10:
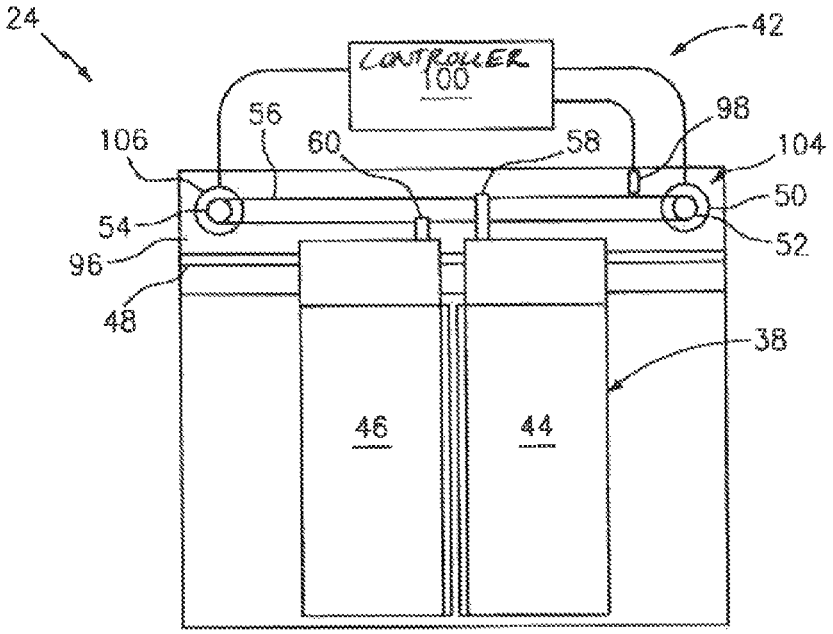
FIG. 10 is a schematic illustration of another elevator car with an elevator door in a closed position.

FIG. 10 is a schematic illustration of the elevator car 24 with an alternate embodiment friction belt drive 104. In contrast the friction belt drive 40 of FIGS. 2 and 3, the friction belt drive 104 includes an additional motor 106 which is connected to the header 96. An output shaft of this motor 106 is connected to and drives the second sheave 54. In addition, the controller 100 is configured in signal communication with the motor 106, and may control the motor 106 in a similar fashion as described above with reference to FIG. 9.

A person of skill in the art will recognize the foregoing friction belt drives may be connected to the elevator door panels with various types of linkages other than the brackets illustrated in the drawings. In addition, the friction belt drives may be connected to one of the elevator door panels, where that panel is connected to the other door panel with a follower linkage. The present invention therefore is not limited to any particular types of door linkages.

A person of skill in the art will recognize the foregoing friction belt drives may also or alternatively be used to move an elevator door of a landing. A person of skill in the art will also recognize the friction belt drives may be configured with various types of elevators other than a traction elevator as illustrated in FIG. 1. The present invention therefore is not limited to any particular elevator door or elevator configurations.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. An elevator system, comprising:

a linkage adapted to attach to an elevator door;

a friction belt drive adapted to move the elevator door with the linkage between an open position and a closed position, the friction belt drive including a v-belt with one or more markers arranged along a length of the v-belt; and a control system adapted to control the friction belt drive, the control system including a sensor adapted to detect at least one of the markers;

wherein a first of the markers is configured as a protrusion or an aperture.

2. The elevator system of claim 1, wherein the first of the markers is configured as the protrusion.

3. The elevator system of claim 1, wherein the first of the markers is configured as a through-hole.

4. The elevator system of claim 1, wherein the first of the markers is configured as a dimple.

5. The elevator system of claim 1, wherein the v-belt has a trapezoidal cross-sectional geometry.

6. The elevator system of claim 1, wherein the v-belt forms a loop and extends between an inner belt side and an outer belt side; and the markers are arranged at the inner belt side.

7. The elevator system of claim 1, wherein the v-belt forms a loop and extends between an inner belt side and an outer belt side; and the markers are arranged at the outer belt side.

8. The elevator system of claim 1, wherein the sensor is configured as one of a proximity sensor, an optical sensor, a touch sensor, a magnetic sensor and a near field sensor.

9. The elevator system of claim 1, wherein the friction belt drive further includes a motor, a first sheave connected to the motor, and a second sheave; and the v-belt wraps around the first and the second sheaves.

10. The elevator system of claim 9, wherein the first sheave is configured as a plain sheave.

11. The elevator system of claim 9, wherein the motor is adapted to rotate the first sheave in response to receiving a control signal;

the sensor is adapted to provide a sensor signal indicative of a position of at least one of the markers; and the control system further includes a controller adapted to receive the sensor signal; and provide the control signal as a function of the sensor signal to at least partially compensate for slippage between the v-belt and the first sheave.

12. The elevator system of claim 9, wherein the sensor is adapted to provide a sensor signal indicative of a position of at least one of the markers; and the control system is adapted to determine a position of the elevator door as a function of the sensor signal.

13. The elevator system of claim 9, wherein the friction belt drive further includes a second motor that is connected to the second sheave.

14. The elevator system of claim 1, further comprising:

the elevator door;

wherein the elevator door includes one or more door panels; and wherein the linkage is attached to at least one of the one or more door panels.

15. An elevator system, comprising:

a linkage adapted to attach to at least one panel of an elevator door;

a friction belt drive adapted to move the elevator door with the linkage between an open position and a closed position, the friction belt drive including:

a motor;

a plurality of sheaves including a first sheave connected to the motor; and a cogged belt wrapped around the sheaves, and including a plurality of cogs; and a sensor adapted to detect at least one of the cogs.

16. The elevator system of claim 15, wherein the cogged belt is configured as a v-belt with a plurality of protrusions arranged along a length of the v-belt.

17. The elevator system of claim 16, further comprising a control system adapted to control the friction belt drive, the control system including the sensor.

18. A system for moving a door between an open position and a closed position, the system comprising:

a motor;

a plurality of sheaves including a plain sheave connected to the motor;

a v-belt wrapped around the sheaves, and including one or more markers arranged along a length of the v-belt, wherein a first of the markers is configured as one of a protrusion and an aperture;

a linkage adapted for connecting the v-belt to the elevator door; and a control system adapted to control the motor, the control system including a sensor adapted to detect at least one of the markers.

19. The system of claim 18, wherein the control system further includes a controller adapted to receive the sensor signal from the sensor, and provide a control signal to the motor as a function of the sensor signal to at least partially compensate for slippage between the v-belt and the plain sheave.

* * * * *